United States Patent [19]

Wiesenfarth et al.

[11] Patent Number: 4,564,826

[45] Date of Patent: Jan. 14, 1986

[54] MULTIPLE MITERED CIRCULAR WAVEGUIDE BEND

[75] Inventors: Hans J. Wiesenfarth, Montclair; Geza Dienes, Claremont, both of Calif.

[73] Assignee: Andrew Corporation, Chicago, Ill.

[21] Appl. No.: 597,480

[22] Filed: Apr. 6, 1984

[51] Int. Cl.[4] ..... H01P 1/02

[52] U.S. Cl. ..... 333/249; 343/890; 333/254

[58] Field of Search ..... 333/249, 254; 72/331, 72/369; 29/600, 157 A; 343/891, 890

[56] References Cited

U.S. PATENT DOCUMENTS

| | | | |
|---|---|---|---|
| 2,583,401 | 1/1952 | Weltmer | 29/157 A X |
| 2,708,686 | 5/1955 | Bernard et al. | 343/890 X |
| 3,672,202 | 6/1972 | Barber | 333/249 X |
| 3,977,706 | 8/1976 | Schneider | 29/157 A X |

FOREIGN PATENT DOCUMENTS

| | | | |
|---|---|---|---|
| 2718684 | 11/1978 | Fed. Rep. of Germany | 343/890 |
| 2446139 | 9/1980 | France | 29/157 A |
| 0139224 | 10/1981 | Japan | 29/157 A |

*Primary Examiner*—Eugene R. LaRoche
*Assistant Examiner*—Benny T. Lee
*Attorney, Agent, or Firm*—Leydig, Voit & Mayer, Ltd.

[57] ABSTRACT

A device for providing a low VSWR match at a bend between two straight circular waveguides has an odd number of at least three circular waveguide sections of approximately equal length along their axes mitered at both of their ends, the length chosen to be an odd multiple of a quarter guide wavelength at the desired operating frequency, and the waveguide sections being mitered so that the device is symmetrical about the bisecting plane of the bend. The ratios of the angles between the adjacent waveguide sections around the bend are approximately binomial coefficients in order to obtain a maximally flat passband.

8 Claims, 4 Drawing Figures

MULTIPLE MITERED CIRCULAR WAVEGUIDE BEND

FIELD OF THE INVENTION

The present invention relates generally to UHF and microwave power transmission, and more particularly to antenna feed systems for UHF broadcast television.

BACKGROUND OF THE INVENTION

Circular waveguide has recently been developed for providing a vertical feed to antennas for UHF broadcast television. In contrast to rectangular waveguide of comparable size, circular waveguide is easily pressurizable to two pounds per square inch to prevent hydration, and circular waveguide prevents a uniform profile so that wind loading is independent of direction. Circular waveguide also offers lower attenuation and higher power handling capability.

Similar improvements should be obtained if circular waveguide is also used for the horizontal run from the transmitting station to the base of the antenna tower. This presents a difficulty, however, in connecting or bending from the horizontal section of circular waveguide to the vertical section of waveguide feeding upwardly to the antenna. It is easy, for example, to use rectangular waveguide and a 90° rectangular bend since it is well known that a rectangular waveguide can be distorted into a bend without a radical effect on either the cutoff frequency or general field configuration of the dominant $TE_{10}$ mode in the bend. Manufacturing tolerances for a right angle bend using rectangular waveguide are not extreme so long as the bend takes place gradually. Even at UHF frequencies wherein the waveguide dimensions are on the order of 13 to 17 inches, a right angle bend using rectangular waveguide is easily obtained since the faces of the rectangular waveguide bend are easily fabricated from flat sheet metal. In contrast, a gradual bend using circular waveguide requires rather tight manufacturing tolerances to avoid unwanted reflections and signal distortion.

SUMMARY OF THE INVENTION

The primary object of the invention is to facilitate the use of circular waveguide for conveying electromagnetic energy horizontally as well as vertically to an antenna.

Another object of the invention is to provide a circular waveguide bend that is easy to fabricate for coupling large diameter waveguides.

Still another object of the invention is to provide an economical method for constructing a circular waveguide bend that provides a good VSWR match over a desired band of frequencies.

The present invention provides a bend for joining two straight sections of circular waveguide which convey electromagnetic energy at a desired frequency. Briefly, according to the present invention, the straight sections of circular waveguide are joined by a waveguide bend comprising an odd number of at least three mitered circular waveguide sections. The axial lengths of the mitered sections are chosen to be an odd multiple of a quarter guide wavelength. For tight bends, for example, three mitered sections are used that are each approximately a quarter of a guide wavelength. The waveguide sections are mitered and joined so that the mitered waveguide bend is symmetrical with respect to the bisecting plane of the angle between the two straight waveguide sections. The frequency response of the mitered circular waveguide bend is dependent upon the bend angles between the waveguide sections. To obtain a maximally flat response, the ratios of the bend angles between the adjacent sections are binomial coefficients. Since the waveguide sections are obtained merely by mitering a straight circular waveguide of constant diameter, the multiple mitered circular waveguide bend is easily and inexpensively manufactured by a cut-and-weld technique.

BRIEF DESCRIPTION OF THE DRAWINGS

These and other objects and advantages of the invention will become apparent from the following detailed description and the accompanying drawings, in which.

While the invention will be described in connection with certain preferred embodiments, it will be understood that it is not intended to limit the invention to those particular embodiments. On the contrary, it is intended to cover all alternatives, modifications and equivalents, as may be included within the spirit and scope of the invention as defined by the appended claims.

DESCRIPTION OF THE PREFERRED EMBODIMENTS

Figure 1:
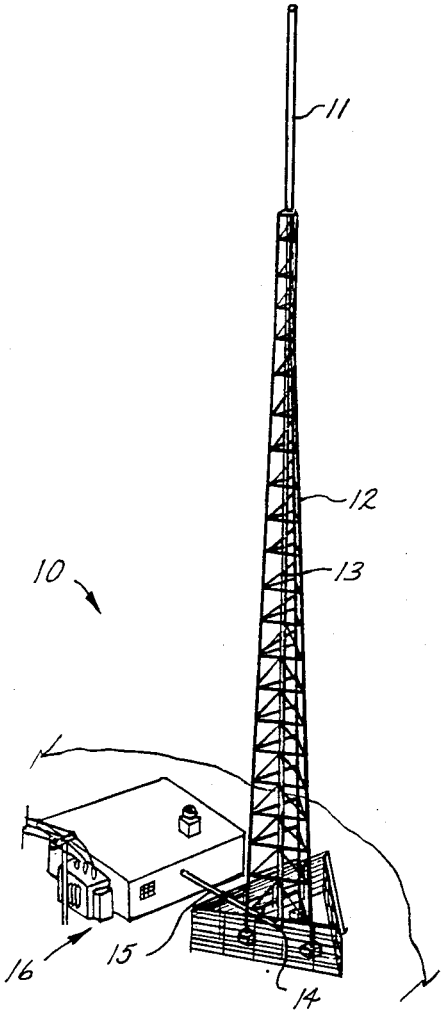
FIG. 1 is a pictorial diagram of a commercial broadcast UHF-TV transmitting station including a traveling wave, slotted array antenna fed by horizontal and vertical sections of circular waveguide.

Turning now to the drawing, there is shown in FIG. 1 a state-of-the-art commercial broadcast UHF-TV transmitting station generally designated 10. To radiate TV signals over a wide service area, a traveling wire, slotted array antenna 11 is mounted at the top of a tower 12. The antenna 11 is essentially a waveguide having spaced apertures (not shown) enclosed within a radome which is pressurized to about two pounds above atmospheric pressure to prevent hydration within the waveguide. The antenna 11 preferably is a TRASAR (trademark) antenna manufactured and sold by Andrew Corporation, 10500 West 153rd Street, Orland Park, Ill. 60462. This particular kind of antenna is preferred since the travel-wave slotted array antenna may be optimized for both azimuth and elevation radiation patterns for any given service area, although the construction of the antenna is not part of the present invention.

The traveling-wave slotted array antenna 11, and alternative kinds of UHF-TV antennas are easily fed by a circular waveguide. By using circular waveguide rather than the conventional rectangular waveguide, a very low attenuation or loss and high power handling capability are obtained. Moreover, by using an appropriate circular waveguide system (described below in conjunction with FIG. 2) there is extremely low signal distortion so that ghosting, unwanted reflections and picture smear are eliminated. The circular waveguide is pressurizable to two Lb/in$^2$ (14 kPa) above atmospheric pressure. Thus, the circular waveguide may provide an air path for pressurization of the transmitting antenna 11.

To feed electromagnetic energy to the antenna 11, a vertical section 13 of circular waveguide depends from the antenna 11 to the base of the tower 12. The waveguide section 13 is essentially an aluminum pipe approximately fifteen inches in diameter. At the base of the tower, a circular waveguide bend 14 according the invention couples the vertical section of circular waveguide 13 to a horizontal section of circular waveguide 15 fed from a transmitter (not shown) inside a transmitter building generally designated 16.

The multiple mitered circular waveguide bend 14 permits the use of continuous circular waveguide from the transmitter building 16 to the antenna 11. The horizontal waveguide section 15 need not be rectangular, since the bend 14 need not be a conventional E plane or H plane rectangular bend.

Figure 2:
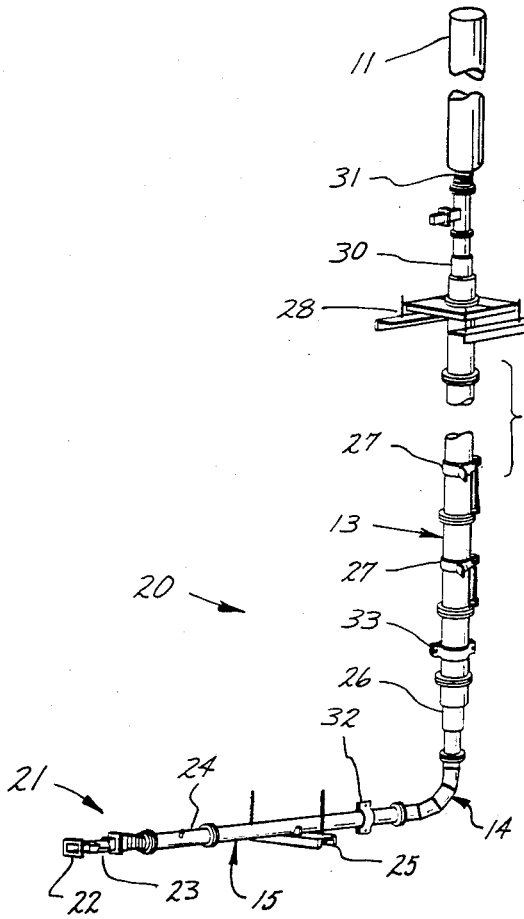
FIG. 2 is a pictorial diagram of a circular waveguide system for the UHF-TV transmitting station of FIG. 1 and employing a multiple mitered circular waveguide bend according the present invention for joining the horizontal and vertical circular waveguide sections.

Turning now to FIG. 2 there is shown in greater detail the circular waveguide system generally designated 20 conveying electromagnetic energy from the transmitter building 16 to the antenna 11. The components in the system 20 other than the multiple mitered bend 14 are known components manufactured and sold by Andrew Corporation, 10500 West 153rd Street, Orland Park, Ill. 60462. To connect the antenna system 20 to a transmitter (not shown) having a rectangular waveguide output, an input assembly 21 having a rectangular input 22 and a step twist 23 feeds the horizontal section 15 of circular waveguide. A gas barrier 24 is installed adjacent to the input assembly 21 in order to pressurize the waveguide system 20 and the antenna 11 to 2 Lb/in$^2$ in order to prevent hydration. Hydration refers to the collection and possible freezing of moisture in the system, which might interfere with signal transmission. The horizontal waveguide section 15 is mechanically supported by a horizontal spring hanger 25. The horizontal spring hanger 25 also permits vertical movement of the horizontal run 15 caused by differential expansion and contraction of the vertical waveguide run 13.

The horizontal waveguide 15 and the vertical waveguide 13 are joined by a multiple mitered circular waveguide bend 14 according to the present invention. The particular construction of the bend 14 is not only economical but provides a low VSWR match between the horizontal waveguide section 15 and the vertical waveguide section 13. By definition, a low VSWR means that substantially all of the electromagnetic energy from the transmitter building 16 is conveyed from the horizontal run 15 to the vertical run 13 and the antenna 11, rather than being reflected back to the transmitter building 16. It is undesirable to reflect back power since it is not radiated by the antenna 11 and could possibly damage the transmitter.

In order to provide low loss transmission from the base of the tower 12 to the antenna 11, the diameter of the vertical waveguide run 13 is slightly increased with respect to the diameter of the horizontal run 15. For conveying electromagnetic radiation at a frequency of approximately 700 megahertz, for example, the horizontal run 15 is comprised of a 13.5 inch diameter waveguide, and the vertical run 13 is of a 15 inch diameter waveguide. A stepped transformer 26 provides a low VSWR connection between the smaller diameter waveguide of the horizontal run 15 and the larger diameter waveguide of the vertical run 13.

To provide mechanical support for the vertical waveguide run 13, a vertical restraining spring hangers 27 are provided which also prevent lateral motion and accommodate differential expantion and contraction of the vertical waveguide portion 13 with respect to the tower 12. A top support hanger 28 anchors and secures the waveguide at the top of the vertical run 13.

An output assembly 29 connects the antenna 11 to the vertical waveguide run 13. Another stepped transformer 30 is provided to reduce the waveguide diameter to feed a cross polarization filter 31 connected to the input of the antenna 11. The cross polarization filter 31 ensures that the microwave energy fed into the antenna 11 is polarized in a desired direction regardless of variations in polarization due to mode conversion or rotation of polarization as the electromagnetic energy is conveyed through the waveguide system 20. It is desirable, however, to adjust the waveguide system 20 so that the polarization of the electromagnetic radiation entering the polarization filter 31 is approximately the same as the desired polarization exiting the filter. Then the energy loss in the polarization filter 31 is insubstantial. A large adjustment in the polarization angle is provided by the step twist 23 at the input assembly 21. A fine adjustment of the polarization is obtained by axial ratio compensators 32 and 33. The axial ratio compensators 32, 33 are rotatable to provide a corresponding rotation of the polarization angle. The axial ratio compensator 32 on the horizontal run 15 is adjusted so that the direction of polarization in the bend 14 is at right angles to the plane of the bend. The bend 14, in other words, works best if it is a "H bend." If the direction of polarization is at a skew angle with respect to the bend 14, mode conversion occurs wherein a phase shifted version of the signal is generated having orthogonal polarization to the original signal. This mode conversion can cause signal distortion such as ghosting, unwanted reflections and picture smear. Hence, the axial ratio compensator 32 is adjusted to eliminate such signal distortion. The second axial ratio compensator 33 on the vertical run 13 is adjusted to minimize the power absorbed by the cross polarization filter 31 to thereby maximize the power radiated by the antenna 11.

From the above, it is apparent that the circular waveguide bend 14 permits the use of a continuous circular waveguide run 15 from the transmitter to the antenna 11. It is also apparent that the overall performance of the transmitting system 10 in FIG. 1 is affected by the characteristics of the bend 14. These characteristics are in turn a function of the dimensional tolerances of the bend 14.

By analogy to rectangular waveguide H bends and E bends, one might attempt to construct a circular waveguide bend by physically bending a straight section of circular waveguide into an arcuate shape. If the radius of the bend is very large compared to a guide wavelength, it might be thought that the general electromagnetic field configuration in the waveguide will not be significantly affected so that a low VSWR match may be obtained. In practice, however, it is very difficult to precisely bend a section of cylindrical waveguide. An even more important consideration is that the diameter of the circular waveguide used at UHF television frequencies is on the order of 13 to 17 inches, so that a gradual arcuate bend would result in a waveguide component that is unreasonably large and difficult to manufacture to precise tolerances by mechanical bending.

According to the invention, a bend for providing a low VSWR match between two straight circular waveguide sections is comprised of an odd number of at least three circular waveguide sections each mitered at both of its ends, wherein each section has an axial length that is approximately an odd multiple of a quarter of the guide wavelength at the desired operating frequency, and wherein the assembly of mitered sections is symmetrical with respect to the bisecting plane of the angle of the bend.

Figure 3:
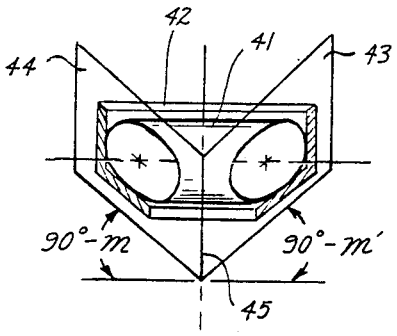
FIG. 3 is a diagram illustrating mitering of a circular waveguide section.

Each circular waveguide section being mitered at both of its ends has beveled planar end portions and the planes of the beveled end portions intersect at a line that lies in a plane perpendicular to the axis longitudinal of the cylindrical waveguide section. Turning to FIG. 3, there is shown a section of cylindrical waveguide 41 mitered at each of its ends in this fashion and disposed on a mitering jig 42. Planes 43 and 44 are the planes of the end portions of the mitered section 41 and are the planes within which a saw (not shown) is guided. The line of intersection 45 denotes the pivot axis of the saw (not shown).

The significance of mitering in this fashion is that mitered sections of circular waveguide may be easily joined together into a planer assembly providing a continuous passageway for electromagnetic energy. The waveguide bend 14 is planar not only to facilitate the jigging of the assembly before welding or soldering, but also to prevent the mode conversion problem mentioned above caused by the polarization vector being at a skew angle with respect to the planes of the individual bend angles in the assembly. The analogy to carpentry is appropriate since the use of a miter box in cutting picture frame molding, for example, has a similar aim to eliminate gaps in a flat assembly.

Figure 4:
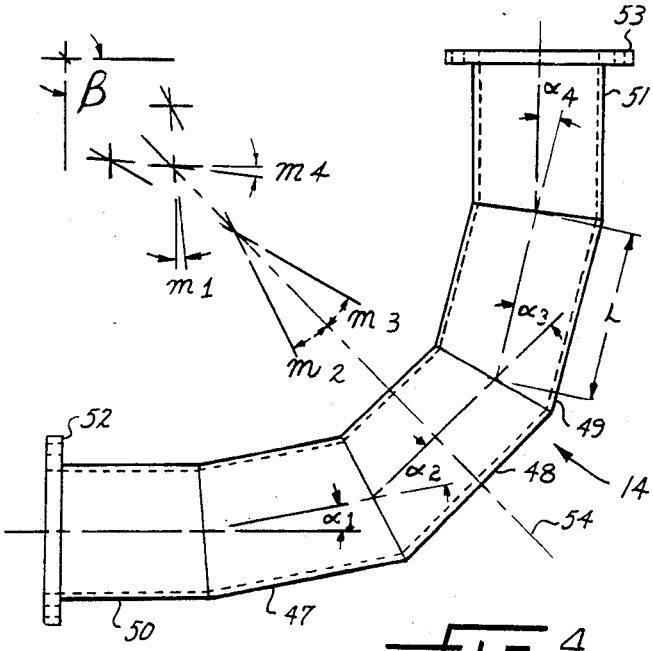
FIG. 4 is a plan view of the multiple mitered circular waveguide bend used in the circular waveguide system of FIG. 2.

Turning now to FIG. 4 there is shown a preferred embodiment of the multiple mitered circular waveguide bend 14. The bend 14 is comprised of three mitered circular waveguide sections 47, 48, and 49, each being mitered at both of its ends, and all being sequentially connected together, the section 48 being the middle section. Beveled sections 50 and 51 of circular waveguide have respective conventional flanges 52 and 53 for connecting the beveled sections 50 and 51 to other straight sections, such as the horizontal section 15 and the vertical section 13 shown in FIG. 2. Each of the mitered sections 47, 48, and 49 has an axial length L that is approximately a quarter of a guide wavelength long. It should be recalled that the wavelength of electromagnetic radiation in a waveguide ($\lambda g$) is greater than the wavelength in free space ($\lambda$), according to the equation:

$$\lambda_g = \frac{\lambda}{\sqrt{1-(f_c/f)^2}}$$

wherein $f_c$ is the cutoff frequency of the waveguide and f is the frequency of the electromagnetic radiation. For the dominant $TE_{11}$ mode in a cylindrical waveguide having an air dielectric, the cutoff frequency is approximately the velocity of light c ($3\times10^{10}$ cm/sec) divided by 1.7 times the inner diameter of the waveguide (in centimeters).

The bend 14 is also symmetrical about the plane 54 which bisects the bend angle $\beta$ between the beveled straight sections 50 and 51. Due to the fact that the axial length L is an odd multiple of a quarter of a guide wavelength, and due to the fact that the bend 14 is symmetrical about the bisecting plane 54, reflections caused by the individual bend angles $\alpha_1$, $\alpha_2$, $\alpha_3$, $\alpha_4$ between the sections 50, 47, 48, 49 and 51, will cancel, leading to a low VSWR match. The cancellation of the reflections as a function of frequency once the axial length L is fixed is, however, a function of the individual bend angles $\alpha_1$, $\alpha_2$, $\alpha_3$, and $\alpha_4$. As shown in FIG. 4 the individual bend angles $\alpha_1$, $\alpha_2$, $\alpha_3$, and $\alpha_4$, are specifically defined as the respective angular deviations between the adjacent cylindrical waveguide sections, and the sum of the individual bend angles $\alpha_1+\alpha_2+\alpha_3+\alpha_4$ is equal to the total bend angle $\beta$. Symmetry with respect to the bisecting plane 54 requires that $\alpha_1=\alpha_4$ and $\alpha_2=\alpha_3$ and thus $\alpha_1+\alpha_2=\alpha_3+\alpha_4=45°$. Consequently, the frequency dependence of the reflections and hence the VSWR as a function of frequency is a function of the ratio of $\alpha_2/\alpha_1$.

The dependence of the VSWR on frequency is not unlike the frequency response of the stepped transformers 26 and 30 in the circular waveguide system of FIG. 2. It is known, for example, that the bandwidth of the VSWR for the stepped transformer is a maximum if the individual reflections at the steps follow a binomial law. The same is found to be true for the multiple mitered circuit waveguide bend 14 according to the present invention. In general, if there are n sections each being mitered at both of its ends in the multiple mitered circular waveguide bend, the bend angles $\alpha_1, \alpha_2, \alpha_3, \ldots, \alpha_n$ should bear the same respective proportions as the binomial coefficients 1, n, n(n−1)/2 . . . n, 1 of the expression (a+b) raised to the nth power. For the case of n=3, the binomial coefficients are 1, 3, 3, 1. Thus, knowing that $\alpha_2/\alpha_1=3$ and $\alpha_1+\alpha_2=45°$, and by solving these simultaneous equations, one obtains the result that $\alpha_1=11.25°$ and $\alpha_2=33.75°$. These angles correspond to the preferred embodiment shown in FIG. 4.

Alternative embodiments of the multiple mitered waveguide band may have different ratios for the angles $\alpha_1$ to $\alpha_4$ to obtain different frequency responses. Because of symmetry about the bisecting plane 54, (which is one of the two planes consisting of all of the points equidistant from the axes of the beveled straight sections 50 and 51), the reflections caused by the individual bend angles $\alpha_1$, $\alpha_2$, $\alpha_3$, $\alpha_4$ will cancel at the center frequency of the response regardless of the ratios of the angles. The ratios of the angles could, for example, follow a Tchebyscheff, cosine or exponential law. By analogy to the design of step transformers, if a certain maximum reflection coefficient may be tolerated within the operating band, the Tchebyscheff coefficients result in an optimum design which allows the reflection coefficient to cycle between zero and the maximum within the band and to increase sharply outside the band. In this case the design ratios for the angles are a function of the desired bandwidth and are given in Table 31-2 on page 31-17 of Jasik, *Antenna Engineering Handbook*, 1961 McGraw-Hill, Inc. For three mitered sections as shown in FIG. 4, the ratio of $$\alpha_2/\alpha_1=8-6\cos^2\theta,$$

where $\theta=(1-F)\pi/2$ and F is one-half of the bandwidth divided by the center frequency. For three mitered section as shown in FIG. 4, the widest bandwidth corresponds to F=1, and the four bend angles $\alpha_1$ to $\alpha_4$ are 15°, 30°, 30°, and 15° for a 90° bend.

Once the bend angles $\alpha_1$ to $\alpha_4$ have been calculated, the corresponding miter angles $m_1$ to $m_4$ are calculated as merely one half of the corresponding bend angles $\alpha_1$ to $\alpha_4$. This should be evident from the fact that the intersection of two cylinders whose axis intersect at the bend angle $\alpha_i$ lies in a plane that is perpendicular to the bisector of the bend angle $\alpha_i$. The respective miter angles m,m' are set up with respect to the jig 42 as shown in FIG. 3.

In view of the above, a multiple mitered circular waveguide bend has been described which is inexpensive and easy to manufacture. It is particularly advantageous for use at the bottom of a vertical run of circular waveguide feeding a commercial broadcast UHF-TV antenna so that continuous circular waveguide may run from the transmitter to the antenna. It has been shown that the ratios of the bend angles between the circular waveguide sections are chosen to obtain a maximum bandwidth about the desired operating frequency.

What is claimed is:

1. A multiple mitered circuit waveguide bend for providing a low VSWR connection between first and second circular waveguides each having a respective longitudinal axis, said axes intersecting at an angle $\beta$, said waveguides conveying electromagnetic energy having a predetermined guide wavelength $\lambda_g$, said waveguide bend comprising an odd number n of mitered sections of circular waveguide, said odd number n being at least three, each of said mitered sections having approximately the same length L that is an odd multiple of one-quarter of said guide wavelength $\lambda_g$ and each mitered section being mitered at both of its ends, a first one of said mitered sections having a first one of its ends connected to an end of said first circular waveguide, said first mitered section having a longitudinal axis intersecting the longitudinal axis of said first circular waveguide at an angle of $\alpha_1$, for each integer i between one and n the ith one of said mitered sections having a first one of its ends connected to the second one of the ends of the (i−1)th mitered section and said ith one of said mitered sections having a longitudinal axis intersecting the longitudinal axis of the (i−1)th mitered section at an angle $\alpha_i$, the nth one of said mitered sections having a first one of its ends connected to the second one of the ends of the (n−1)th mitered section and said nth one of said mitered sections having a longitudinal axis intersecting the longitudinal axis of the (n−1)th mitered section at an angle $\alpha_n$, said second circular waveguide having an end connected to the second end of the nth mitered section and the longitudinal axis of said second circular waveguide intersecting the longitudinal axis of said nth mitered section at an angle $\alpha_{(n+1)}$, and wherein the respective ratios $\alpha_2\alpha_1, \ldots, \alpha_{(i+1)}/\alpha_i, \ldots, \alpha_{(n+1)}/\alpha_n$ of the angles $\alpha_1, \ldots, \alpha_i, \ldots, \alpha_{(n+1)}$ are approximately equal to the respective ratios $C_2/C_2, \ldots, C_{(i+1)}/C_i, \ldots, C_{(n+1)}/C_n$ of the binomial coefficients $C_1, \ldots, C_i, \ldots, C_{(n+1)}$ of the expansion $(a+b)^n$, where a and b are algebraic variables, so that $C_1=1$, $C_2=n$, $C_3=n(n-1)/2, \ldots, C_n=n$ and $C_{(n+1)}=1$.

2. The waveguide bend as claimed in claim 1, wherein the number n of said mitered sections is 3.

3. The waveguide bend as claimed in claim 2, wherein said angle $\beta$ of intersection between the first and second circular waveguides is approximately a right angle, the angle $\alpha_1$ is of approximately 11.25°, the angle $\alpha_2$ is of approximately 33.75°, the angle $\alpha_3$ is of approximately 33.75°, and the angle $\alpha_4$ is of approximately 11.25°.

4. An antenna feed systems of the kind for coupling electromagnetic energy at a predetermined guide wavelength from a transmitter at substantially ground level to an antenna substantially above ground level and mounted on a tower horizontally displaced from the transmitter, said antenna feed system comprising a substantially horizontal first waveguide extending from the transmitter to the base of the tower, a substantially vertical second circular waveguide depending from the antenna to the base of the tower, and a waveguide bend joining the first and second waveguides at the base of the tower, wherein the improvement comprises, said first waveguide is a circular waveguide, said waveguide bend is a multiple mitered circular waveguide bend for providing a low VSWR connection between the first and second circular waveguides, said first and second circular waveguides each having a respective longitudinal axis, said axes intersecting at approximately a right angle, said waveguide bend comprising an odd number n of mitered circular waveguide sections, said odd number n being at least three, each of said mitered sections having a length that is an odd multiple of a quarter of said guide wavelength and each mitered section being mitered at both of its ends, a first one of said mitered sections having a first one of its ends connected to an end of said first circular waveguide and said first mitered section having a longitudinal axis intersecting the longitudinal axis of said first circular waveguide at an angle of $\alpha_1$, for each integer i between one and n the ith one of said mitered sections having a first one of its ends connected to the second one of the ends of the (i−1)th mitered section and said ith one of said mitered sections having a longitudinal axis intersecting the longitudinal axis of the (i−1)th mitered section at an angle $\alpha_i$, the nth one of said mitered sections having a first one of its ends connected to the second one of the ends of the (n−1)th mitered section and said nth one of said mitered sections having a longitudinal axis intersecting the longitudinal axis of the (n−1)th mitered section at an angle $\alpha_n$, said second circular waveguide having an end connected to the second end of the nth mitered section and the longitudinal axis of said second circular waveguide intersecting the longitudinal axis of said nth mitered section at an angle $\alpha_{n+1}$, and wherein the respective ratios $\alpha_2/\alpha_1, \ldots, \alpha_{(i+1)}/\alpha_i, \ldots, \alpha_{(n+1)}/\alpha_n$ of the angles $\alpha_1, \ldots, \alpha_i, \ldots, \alpha_{(n+1)}$ are approximately equal to the respective ratios $C_2/C_1, \ldots, C_{(i+1)}/C_{(i)}, \ldots, C_{(n+1)}/C_n$ of the binomial coefficients $C_1, \ldots, C_i, \ldots, C_{(n+1)}$ of the expansion of $(a+b)^n$, where a and b are algebraic variables, so that $C_1=1$, $C_2=n$, $C_3=n(n-1)/2, \ldots, C_n=n$ and $C_{(n+1)}=1$.

5. The antenna feed system as claimed in claim 4, wherein the number n of said mitered sections is 3 and the angle $\alpha_1$ is of approximately 11.25°, the angle $\alpha_2$ is of approximately 33.75°, the angle $\alpha_3$ is of approximately 33.75°, and the angle $\alpha_4$ is of approximately 11.25°.

6. The antenna feed system as claimed in claim 4, wherein the length of each mitered circular waveguide section is one-quarter of said guide wavelength.

7. The antenna feed system as claimed in claim 4, wherein each mitered section has beveled planar end portions and the planes of the beveled end portions intersect at a line that lies in a plane perpendicular to the longitudinal axis of the mitered section.

8. An antenna feed system of the kind for coupling electromagnetic energy at a predetermined guide wavelength from a transmitter at substantially ground level to an antenna substantially above ground level and mounted on a tower horizontally displaced from the transmitter, said antenna feed system comprising a substantially horizontal first waveguide extending from the transmitter to the base of the tower, a substantially vertical second circular waveguide depending from the antenna to the base of the tower, and a waveguide bend joining the first and second waveguides at the base of the tower, wherein the improvement comprises, said first waveguide is a circular waveguide, said waveguide bend is a a multiple mitered circular waveguide bend for providing a low VSWR connection between the first and second circular waveguides, each of said first and second circular waveguides having a respective longitudinal axis, said axes intersecting at approximately a right angle, and said waveguide bend comprises three mitered circular waveguide sections and two beveled circular waveguide sections, each of said mitered circular waveguide sections having a length that is approximately a quarter of said guide wavelength and each mitered section being mitered at both of its ends, a first one of said beveled circular waveguide sections having a longitudinal axis aligned with the longitudinal axis of said first circular waveguide and having a first one of its ends connected to an end of said first circular waveguide, a first one of said mitered sections having a first one of its ends connected to the second end of said first beveled circular waveguide section and said first mitered section having a longitudinal axis intersecting the longitudinal axis of said first circular waveguide at an angle of approximately 11.25°, the second one of said mitered sections having a first one of its ends connected to the second end of said first mitered section and said second mitered section having a longitudinal axis intersecting the longitudinal axis of said first mitered section at an angle of approximately 33.75°, the third one of said mitered sections having a first one of its ends connected to the second end of said second mitered section and said third mitered section having a longitudinal axis intersecting said longitudinal axis of said second mitered section at an angle of approximately 33.75°, the second beveled circular waveguide section having a longitudinal axis aligned with the longitudinal axis of said second circular waveguide and having a first one of its ends connected to the second end of said third mitered section, the axis of said second circular waveguide intersecting the axis of said third mitered section at an angle of approximately 11.25°, and said second circular waveguide having an end connected to the second end of said second beveled waveguide section, and wherein each mitered section has beveled planar end portions and the planes of the beveled end portions intersect at a line that lies in a plane perpendicular to the longitudinal axis of the mitered section.

* * * * *